US007468497B2

(12) United States Patent
Grisoni

(10) Patent No.: US 7,468,497 B2
(45) Date of Patent: Dec. 23, 2008

(54) HEATABLE CONTAINER

(75) Inventor: Jacques Grisoni, La-Croix-sur-Lutry (CH)

(73) Assignee: Cont-Asphalt Ltd. (CH)

( * ) Notice: Subject to any disclaimer, the term of this patent is extended or adjusted under 35 U.S.C. 154(b) by 82 days.

(21) Appl. No.: 11/398,988

(22) Filed: Apr. 5, 2006

(65) Prior Publication Data

US 2007/0012680 A1 Jan. 18, 2007

(30) Foreign Application Priority Data

Jul. 13, 2005 (ZA) ..... 2005/5625

(51) Int. Cl.
*H05B 3/02* (2006.01)
*F24C 5/00* (2006.01)

(52) U.S. Cl. ..... 219/469; 219/202; 219/477; 219/483; 219/470; 392/441; 392/444; 392/447; 126/50; 126/343.5 A; 126/369; 126/271.1; 126/373.1; 126/377.1; 126/378.1; 126/379.1

(58) Field of Classification Search ..... 126/50.1, 126/343.5 A, 343.5 R, 369, 369.1, 271.1, 126/375.1, 377.1, 378.1, 379.1; 392/441, 392/444, 447; 219/202, 477, 483, 469, 470
See application file for complete search history.

(56) References Cited

U.S. PATENT DOCUMENTS 1,962,657 A 6/1934 Hendricks
3,503,381 A 3/1970 Role
3,633,563 A 1/1972 Osborn
3,681,566 A * 8/1972 Sellers ..... 392/456
3,757,745 A * 9/1973 Miller ..... 122/136 R
4,028,527 A 6/1977 Thagard, Jr.
4,661,684 A * 4/1987 Sellers ..... 392/308
5,909,730 A 6/1999 Lehmann et al.

FOREIGN PATENT DOCUMENTS

DE 2137116 2/1973
GB 762796 12/1956

* cited by examiner

*Primary Examiner*—Shawntina Fuqua
(74) *Attorney, Agent, or Firm*—McDonnell Boehnen Hulbert & Berghoff LLP

(57) ABSTRACT

A heatable container suitable for material such as bitumen. The container includes a vessel for holding a flowable material having side wall zones, end wall zones and a base wall zone. The container also includes a heating system for transferring heat to at least the base wall zone as well as a zone disposed along a central longitudinal axis of the vessel. The heating system may also included at least two internal heating ducts for conveying a heat transfer medium, wherein the ducts are disposed substantially parallel relative to the central longitudinal axis of the vessel, and are vertically and horizontally spaced apart relative to one another.

17 Claims, 4 Drawing Sheets

HEATABLE CONTAINER

FIELD OF THE INVENTION

This invention relates to a heatable container, and more particularly, but not exclusively, to a heatable container suitable for heating and transportation of oil refinery residues, bitumen, cut back or similar products (like waxes) which allows the efficient heating of such products without unacceptable degradation due to thermal shock or overheating.

BACKGROUND TO THE INVENTION

Various applications exist where substances, being in the solid phase when under ambient conditions, must be melted in order to be used, or where such substances must be transported in a molten condition. This scenario is for instance encountered when working with bitumen. Bitumen is a viscous substance that is typically used for road surfacing, waterproofing (for instance in tunnels and dams) or roofing. The bitumen must be applied in the liquid phase, i.e. a molten condition, and is then allowed to coagulate once applied. It will be appreciated that it will be advantageous to keep the bitumen in a molten state until used, and also to be able to melt the bitumen in a/solid phase within a reasonable time period.

Problems which are associated with conventional bitumen heating systems are well recognised and can be summarized as follows:

(i) During re-heating of a bitumen-type product with conventional systems, the product is subjected to thermal shock and can become severely degraded. Such degraded bitumen becomes unsuitable for road and pavement surfaces and results in early deterioration, as the thermal shock results in formation at micro fissures in such surfaces due to the change of the ductility of the bitumen.

(ii) As mentioned above, because bitumen is a poor conductor of heat, a considerable period of time is required to re-heat the bitumen. With conventional systems, such period is typically in excess of 20 hours per container. The long heating period which is required with conventional systems is also to a large degree attributable to the inefficiency of such systems.

(iii) Because of the long heating period described in (ii) above, a considerable amount of energy in the form of heating fuel is required to bring the bitumen to the required temperature. Such fuel costs can form a significant part of the cost of civil construction.

OBJECT OF THE INVENTION

The objects of the present invention are generally to overcome or at least minimize the problems with conventional systems which are set out above, namely, to minimize thermal shock to which the product is subjected, to enhance their efficiency, to reduce the heating period and the heat energy required.

It is a further object of this invention to provide a heatable container wherein the contents of the container is heated from the outside of the mass of the product, so as to prevent the contents of being exposed to thermal shock.

It is a yet further object of the invention to provide a heatable container having a large heat transfer surface between a heating medium and a substance to be heated.

It is a still further object of the invention to provide a heatable container being suitable for heating a substance, such as bitumen, without degrading the mechanical or chemical properties of such substance.

SUMMARY OF THE INVENTION

According to the invention there is provided a heatable container comprising:

a vessel, suitable for holding a flowable material, the vessel including side wall zones, end wall zones and a base wall zone; and heating means configured to transfer heat to at least the base wall zone as well as a zone disposed along a central longitudinal axis of the vessel;

the heating means including at least two internal heating ducts, suitable for conveying a heat transfer medium, wherein the ducts are disposed substantially parallel relative to the central longitudinal axis of the vessel, and are vertically and horizontally spaced apart relative to one another.

The internal heating ducts will preferably be sufficiently spaced apart so that peripheries of the respective ducts do not overlap in a horizontal or in a vertical plane.

A further feature of the invention provides for at least one of the internal heating ducts to include a heat transfer fin extending therefrom. Preferably all the internal heating ducts will include heat transfer fins extending therefrom.

The heat transfer fins may be directed towards the base wall zone, and may further include apertures provided therethrough.

The invention further provides that the heat transfer fins may extend substantially along the entire lengths of the internal heating ducts.

In one arrangement, a plurality of heat transfer fins may extend form each internal heating duct, and the heat transfer fins may be substantially rectangular when viewed in plan.

A further feature of the invention provides for the heating means to include external heating ducts that are configured to transfer heat to the base wall zone and to at least part of the side wall zones.

The external heating ducts may be in flow communication with the internal heating ducts, the arrangement being such that in use heat transfer media first passes through the external heating ducts, and thereafter through the internal heating ducts to an exhaust outlet.

The heating means may further comprise two separate heating systems that are operated in parallel, each system including external and internal heating ducts, wherein each system is associated with a particular halve of the vessel.

A further feature of the invention provides for each external heating duct to comprise an outer enclosure adapted to convey heat transfer media, each enclosure at least partially having a common wall with the vessel.

The external enclosure may include baffle plates for forming a discrete flow path within the external enclosure, and the baffle plates may be configured to define a convoluted flow path within the external enclosure, the flow path terminating in an inlet to the internal heating duct.

Alternatively the external heating duct may comprise a plurality of elongate pipes disposed longitudinally about the periphery of the vessel, with the end of adjacent pipes being in flow communication so as to provide a continuous convoluted flow path, the flow path terminating in an inlet to the internal heating duct.

Further according to the invention, the vessel may be in the form of an elongate cylinder having dome-shaped end walls, and the external heating duct may be disposed towards a bottom half of the cylindrical vessel.

Each internal heating duct may be an elongate pipe with a first end being connected to an aperture in the bottom halve of the cylindrical vessel, and a second end connected to an aperture provided in an end wall of the cylindrical vessel.

There is provided for the heat transfer medium to be a gaseous medium, and more particularly to be combustion gasses from any suitable combustion process, and may for instance include a gas burner.

A further aspect of the invention provides for the heatable container as described hereinbefore to be mounted on an ISO frame so as to facilitate transportation of the heatable container. The heat transfer medium may be exhaust gas from an engine of a truck when the heatable container is mounted on a truck.

BRIEF DESCRIPTIONS OF THE DRAWINGS

Preferred embodiments of the invention will now be described by way of non-limiting examples, and with reference to the accompanying drawings in which.

DETAILED DESCRIPTION OF THE INVENTION

Figure 1:
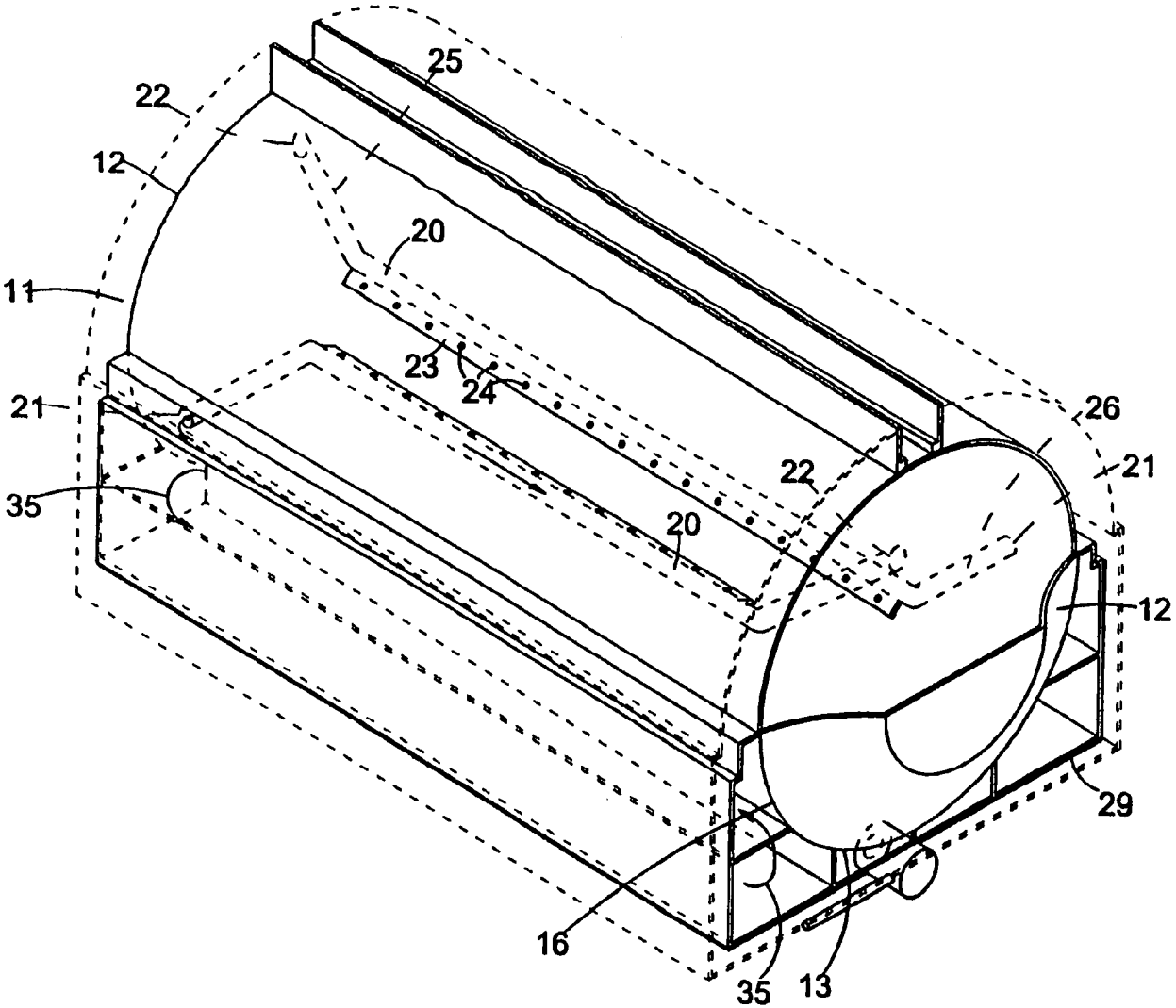
FIG. 1 is a perspective view of a heatable container in accordance with the invention.

Referring to the drawings, in which like numerals indicate like features, a heatable container is generally indicated by reference numeral 10. The heatable container includes a vessel 16 in the form of an elongate cylinder, which includes side wall zones 11, end wall zones 12 in the form of dome-shaped ends, as well as a base wall zone 13.

Figure 2:
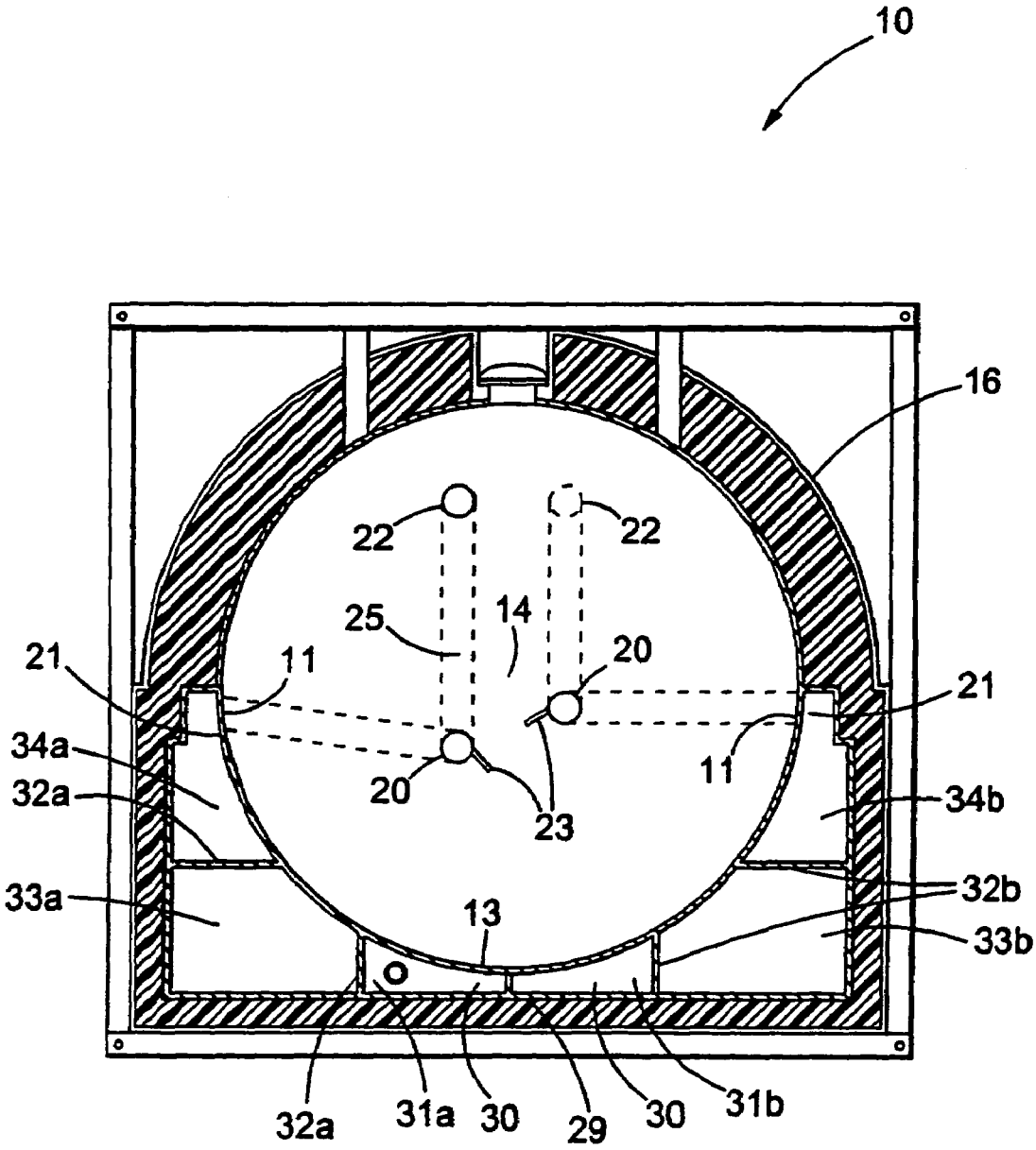
FIG. 2 is a cross-sectional view of the container of FIG. 1.

Referring to FIGS. 1 and 2 the heatable container 10 typically includes a system of heating means for transferring heat to the content of the container, for example bitumen. The heating means include internal heating ducts 20 as well as external heating ducts 30. The external and internal heating ducts are in flow communication, and are connected in series so that a heat transfer medium first enters the external heating ducts 30 and thereafter the internal heating ducts 20. Two sets of heating means are furthermore associated with the heatable container, the two sets functioning in parallel and each set being in contact with one halve of the heatable container.

The external heating ducts 30 are typically in the form of an outer enclosure 29 extending around the base wall zone 13 and at least part of the side wall zones 12 of the heatable container 10. A plurality of partition or baffle plates, 32*a* and 32*b*, are provided between the outer surface of the base wall zone 13 and the enclosure 29, as well as between the outer surface of the side wall zones 11 and the enclosure 29. The baffle plates 32 are configured to divided the volume formed by the enclosure 29 into meandering or convoluted flow passages, and more particularly into first enclosures 31*a* and 31*b*, second enclosures 33*a* and 33*b*, and third enclosures 34*a* and 34*b*. The flow path through these enclosures is indicated by arrow 35.

The third enclosures 34*a* and 34*b* adjacent the side wall zones 11, include outlets 21 which is also the inlets to the internal heating ducts 20. The internal heating ducts 20 are typically in the form of elongate pipes, and each internal heating pipe comprises an inlet 21 and an outlet 22. The inlets are located in the side wall zones 11 whereas the outlets 22 are located in the upper sections of the end wall zones 12. The internal ducts includes inlet sections 26, slanted outlet sections 25, and a section therebetween being disposed substantially parallel relative to the central longitudinal axis of the vessel 16, so as to be able to transfer heat to a central zone 24 of the container. The internal heating ducts 20 are furthermore vertically and horizontally spaced apart relative to one another, and more particularly the internal heating ducts are sufficiently spaced apart so that outer peripheries of the ducts do not overlap in the vertical or horizontal planes. It will be noted that the inlets 21 and outlets 22 of the respective internal heating ducts 20 are located at opposing ends of the container so as to provide more efficient utilisation of heat.

At least one heat transfer fin 23 furthermore extends from each internal heating duct 20. These fins 23 are elongate planar sections that typically extend from after the inlet sections 26 to before the slanted outlet sections 25 of the internal heating ducts, and include a plurality of apertures 24 therethrough. The fins are furthermore slanted towards the base zone 13 so as to prevent solids form accumulating on the upper surfaces of the fins.

Insulation 19 is provided around the container so as to prevent excessive heat loss from the container. The insulation is typically in the form of a packing of mineral wool, glass fibre mat or the like, and a protective outer cladding of metal or plastic material encloses the insulation.

Figure 3:
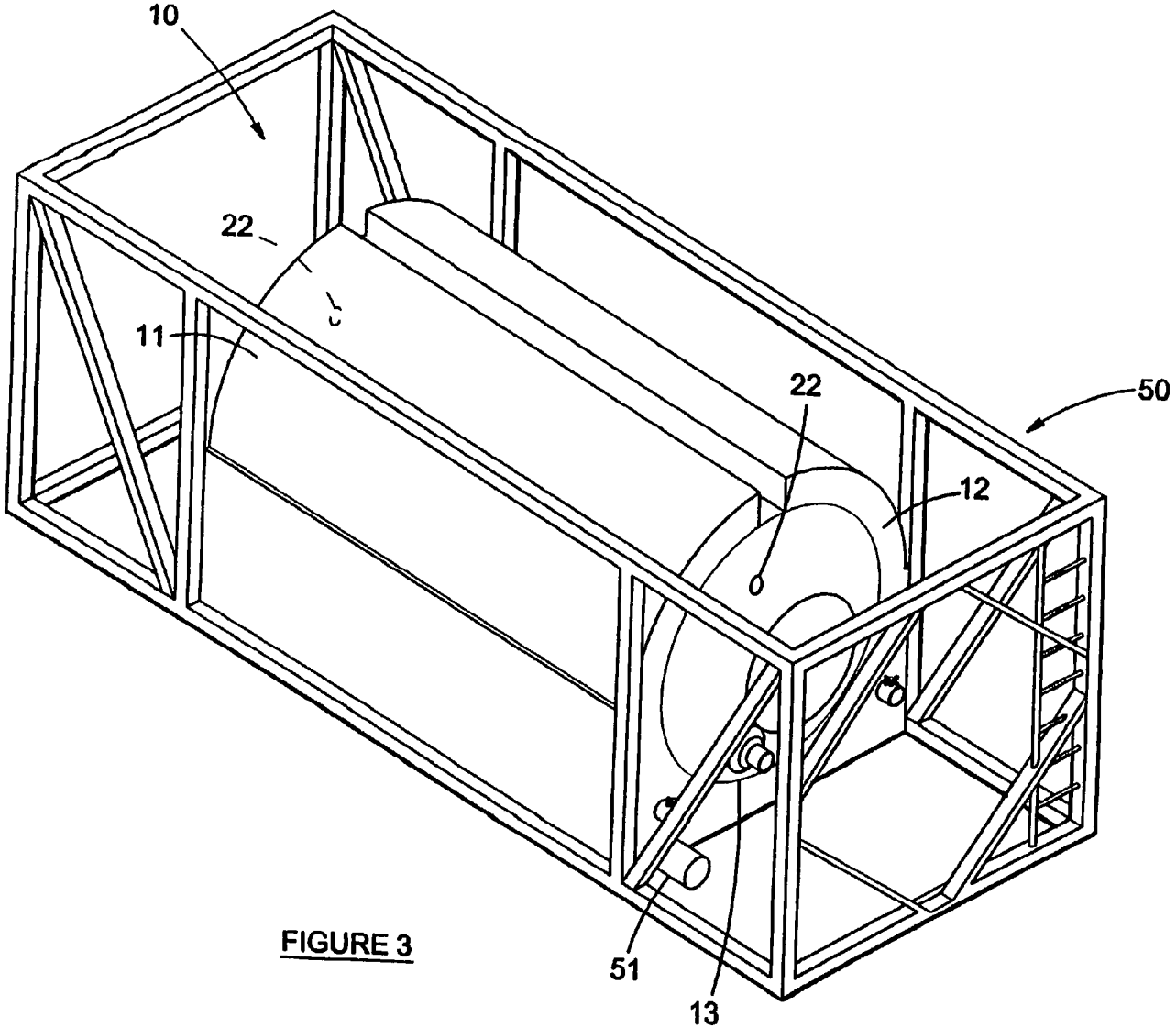
FIG. 3 is a perspective view of the container of FIG. 1 as mounted in an ISO frame for transportation.

FIG. 3 shows the heatable container mounted on a standard ISO frame 50. The frame 50 is of a standard size, which enhances the transferability of the heatable container. The container as shown can for instance be loaded unto a truck or a train. The heat transfer medium is introduced into the heating system via inlet 51. The heat transfer medium will typically be a gaseous heat transfer medium, and may be fuelled by a gas or oil burner, or alternatively the gas may be the outlet gas of an internal combustion engine should the container be transported on a truck. In a preferred embodiment heating is done by means of two burners located at opposing ends of the container so as to ensure proper heat distribution across the bottom surface of the container.

Figure 4:
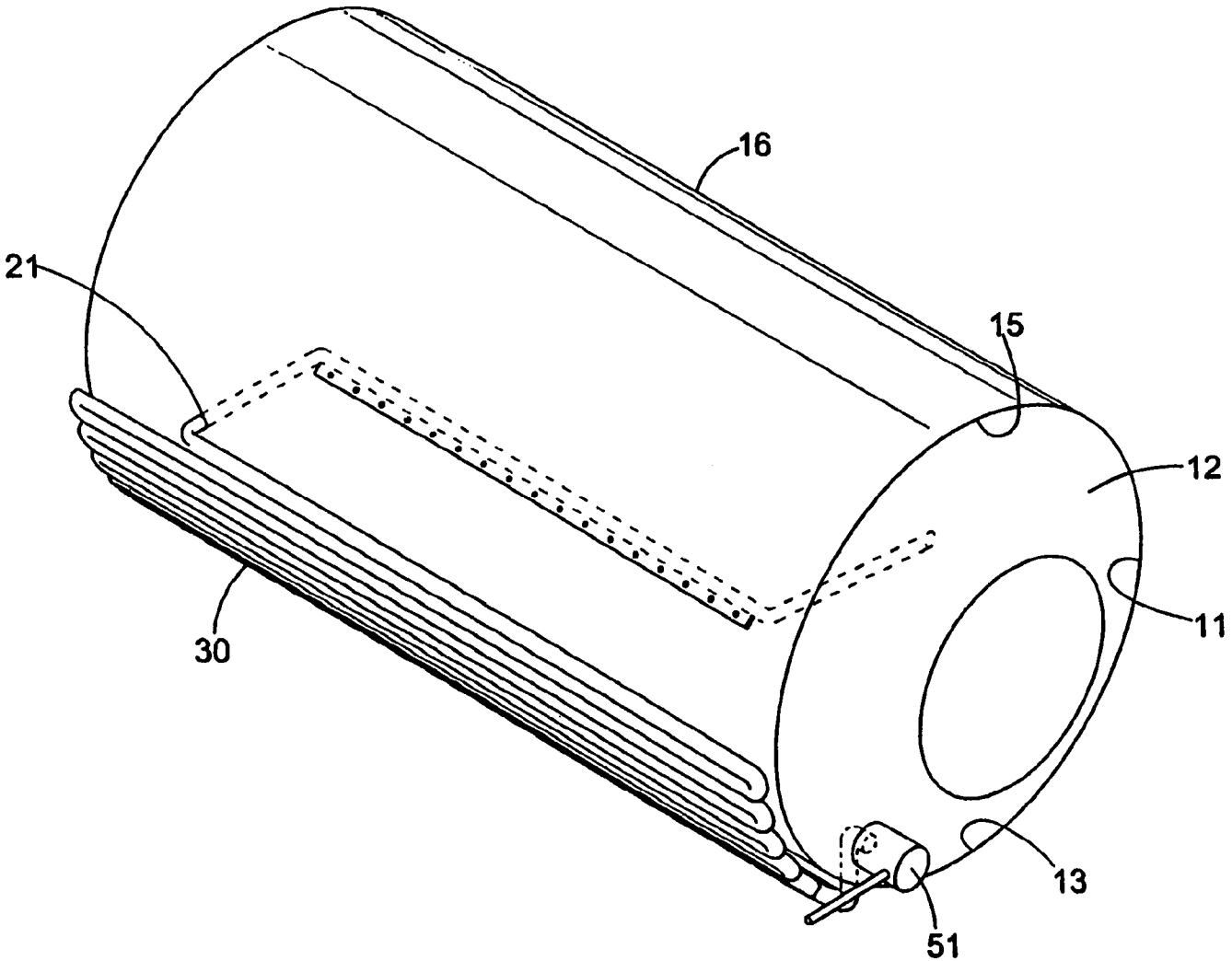
FIG. 4 is an alternative embodiment of the container in accordance with the invention.

An alternative embodiment of the heating system of the heatable container 10 is shown in FIG. 4. In this case the external heating duct 30 is in the form of a plurality of elongate pipes disposed longitudinally about the periphery of the vessel structure 16. The ends of adjacent pipes are in flow communication so as to provide a continuous convoluted flow path, the flow path terminating in an inlet 21 to the internal heating duct 20.

The configuration as described hereinbefore results inefficient heating of the contents of the heatable container, whilst simultaneously preventing material in solid state to accumulate around the internal heating ducts. It is therefore envisaged that the invention will solve the problems associated with known technology. As a result of the increased efficiency in the heating process, the time period for heating the contents of the container is dramatically reduced. Thus for example, with conventional heatable containers, the period for heating a conventional ISO container load will be in excess of twenty five hours. With the arrangement of the invention, this time period can be reduced to below five hours per ton of bitumen. Also, as a result of the increased efficiency, the energy consumption for the heating process is substantially less and can for example be half of that required with conventional heatable containers.

It has been found that the arrangement of the invention provides a large heat transfer area between the heating medium and the interior of the container, which is advantageous from the point of view of efficient heat transfer. It has also been found from specialized laboratory tests that the degradation of material such as bitumen is as a result of thermal shock avoided as a result of the heating via a large heat transfer area. In particular it has been found that a poor quality of bitumen can be successfully heated in the container of the invention to transform such bitumen to a sufficiently liquid state so that it can be dispensed via an outlet in the container.

The above are only two embodiments of the invention and it will be appreciated that many variations are possible without departing from the spirit and scope of the invention. For example a plurality of heat transfer fins may extend from each internal heating duct, and these fins may furthermore be of any suitable profile and orientation. In addition, any type of gas heating mechanism may be used to heat the gas used as heat transfer medium.

The invention claimed is

1. The heatable container comprising:

a vessel, suitable for holding a flowable material, the vessel including side wall zones, end wall zones and a base wall zone; and a heating system configured to transfer heat to at least the base wall zone and thereafter to a zone disposed along a central longitudinal axis of the vessel;

the heating system comprising at least two internal heating ducts, suitable for conveying a gaseous heat transfer medium, wherein the ducts are disposed substantially parallel relative to the central longitudinal axis of the vessel, and are vertically and horizontally spaced apart relative to one another; and wherein the heating system further comprises external heating ducts which are located to transfer heat to the base wall zone and at least part of the side walls zones of the container.

2. The heatable container according to claim 1 wherein the internal heating ducts are spaced from one another so that the peripheries of the respective ducts do not overlap in a horizontal or in a vertical plane.

3. The heatable container according to claim 1 wherein at least one of the internal heating ducts comprises a heat transfer fin extending laterally therefrom.

4. The heatable container according to claim 3 wherein the heat transfer fin is directed towards the base zone of the container.

5. The heatable container according to claim 3 wherein the heat transfer fin comprises a plurality of apertures.

6. The heatable container according to claim 3 wherein the heat transfer fin extends substantially along the entire length of the at least one internal heating duct.

7. The heatable container according to claim 1 further comprising a plurality of heat transfer fins extending from the internal heating ducts.

8. The heatable container comprising a vessel, suitable for holding a flowable material, the vessel including side wall zones, end wall zones and a base wall zone;

a heating system configured to transfer heat to at least the base wall zone and thereafter to a zone disposed along a central longitudinal axis of the vessel;

the heating system comprising at least two internal heating ducts, suitable for conveying a gaseous heat transfer medium, wherein the ducts are disposed substantially parallel relative to the central longitudinal axis of the vessel, and are vertically and horizontally spaced apart relative to one another; and wherein the heating system further comprises external heating ducts which are located to transfer heat to the base wall zone and at least part of the side walls zones of the container and wherein the external heating ducts are in flow communication with the internal heating ducts, the arrangement being such that in use heat transfer media first passes through the external heating ducts, and thereafter through the internal heating ducts to an exhaust outlet.

9. The heatable container comprising a vessel, suitable for holding a flowable material, the vessel including side wall zones, end wall zones and a base wall zone;

a heating system configured to transfer heat to at least the base wall zone and thereafter to zone disposed along a central longitudinal axis of the vessel;

the heating system comprising at least two internal heating ducts, suitable for conveying a gaseous heat transfer medium, wherein the ducts are disposed substantially parallel relative to the central longitudinal axis of the vessel, and are vertically and horizontally spaced apart relative to one another;

wherein the heating system comprises two separate heating systems that are operable in parallel, each system including external and internal heating ducts, wherein each system is associated with a particular half section of the vessel.

10. The heatable container according to claim 8 wherein each external heating duct comprises an outer enclosure adapted to convey heat transfer media, each such outer enclosure having at least one common wall with the vessel.

11. The heatable container according to claim 10 wherein the external enclosure comprises baffle plates for forming a discreet flow path within the external enclosure, and the baffle plates are configured to define a convoluted flow path within the external enclosure, such flow path terminating at an upstream inlet to the internal heating duct.

12. The heatable container according to claim 10 wherein the external heating duct comprises a plurality of elongate pipes disposed longitudinally about the periphery of the vessel, with the end of each of adjacent pipes being in flow communication to provide a continuous convoluted flow path, such flow path terminating with an inlet to the internal heating duct.

13. The heatable container according to claims 1 wherein the vessel is in the form of an elongate cylinder having dome shaped end walls, and the external heating duct is disposed towards the bottom half of the cylindrical vessel.

14. The heatable container according to claim 13 wherein each internal heating duct is an elongate pipe with a first end thereof being connected to an aperture in the bottom half of the vessel, and the other end thereof being connected to an aperture provided in an end wall of the cylindrical vessel.

15. The heatable container according to claim 1 wherein the heat transfer medium is a combustion gas of a combustion process.

16. The heatable container according to claim 1 wherein the container is mounted on an ISO frame that facilitates transportation of the container.

17. The heatable container according to claim 15 wherein the combustion gases are the exhaust gasses from the engine of a truck when the heatable container is mounted on a truck.

* * * * *